US006761095B2

(12) United States Patent
Beauchamp

(10) Patent No.: US 6,761,095 B2
(45) Date of Patent: Jul. 13, 2004

(54) BIT HOLDER

(76) Inventor: Fern Beauchamp, 13 Clayburn Avenue, St. Catharines, Ontario (CA), L2P 2S3

( * ) Notice: Subject to any disclaimer, the term of this patent is extended or adjusted under 35 U.S.C. 154(b) by 57 days.

(21) Appl. No.: 09/983,567

(22) Filed: Oct. 25, 2001

(65) Prior Publication Data

US 2002/0050192 A1 May 2, 2002

Related U.S. Application Data

(60) Provisional application No. 60/243,751, filed on Oct. 30, 2000.

(51) Int. Cl.[7] ..... B25G 1/08
(52) U.S. Cl. ..... 81/490; 81/177.4
(58) Field of Search ..... 81/177.4, 438, 81/439, 490

(56) References Cited

U.S. PATENT DOCUMENTS 2,667,194 A * 1/1954 Fischer et al. ..... 81/438
2,833,548 A * 5/1958 Clark ..... 81/438
2,838,082 A * 6/1958 Lange ..... 81/438
4,514,117 A 4/1985 Scott
5,063,796 A * 11/1991 Gennep ..... 81/177.4
5,740,706 A * 4/1998 Tseng ..... 81/490
5,884,541 A * 3/1999 Habermehl et al. ..... 81/438
5,921,562 A 7/1999 Robison
6,053,675 A 4/2000 Holland
RE36,797 E * 8/2000 Eggert et al. ..... 81/438
6,163,911 A 12/2000 Lin
6,237,451 B1 5/2001 Wei
6,243,902 B1 * 6/2001 Huang ..... 81/490
6,293,173 B1 9/2001 Rowlay
6,305,255 B1 10/2001 Wu
6,490,955 B2 * 12/2002 Chang-Kao et al. ..... 81/439

* cited by examiner

*Primary Examiner*—James G. Smith

(57) ABSTRACT

The present invention a bit holder for use with a drill chuck includes a shaft adapted at one end for releasably mounting to the drill chuck, and at the other end for releasably mounting tool bits therein; and, a housing connected operably to said shaft, said housing defining bit compartments for releasably receiving tool bits therein. The bit holder further including a sleeve for positioning relative to said housing for selectively retaining or for selectively releasing tool bits in said bit compartments. Wherein said housing and said sleeve operably rotate relative each other, wherein said housing or sleeve rotate about a longitudinal shaft axis such that rotating said housing or said sleeve relative each other selectively retains or releases said bits from said bit compartments.

28 Claims, 15 Drawing Sheets

100
110
111
112
114
116
118
126
130
144

124
122
130
152
112
118
116
140
126
150
110
114
81
120
111
144

FIG. - 16
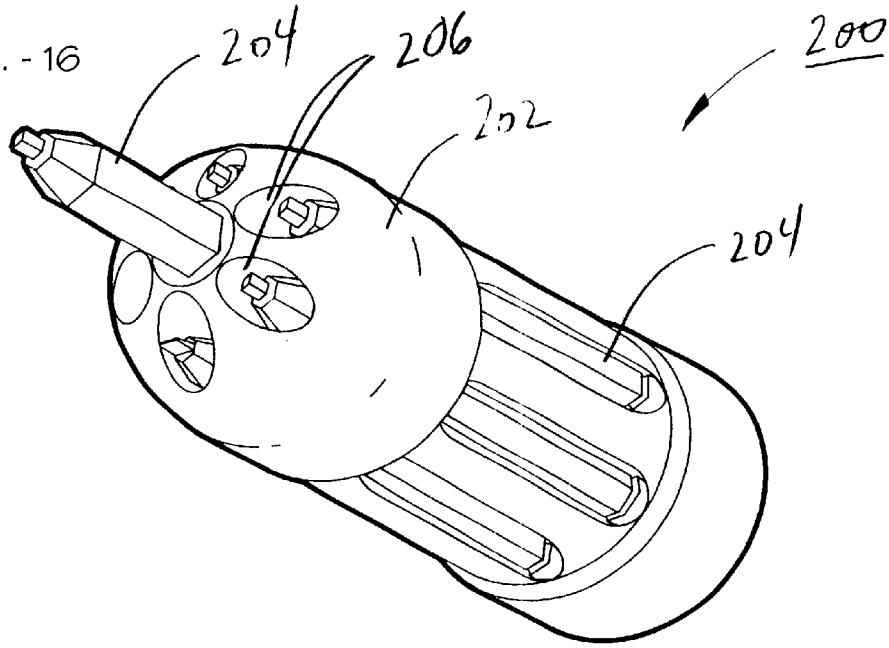
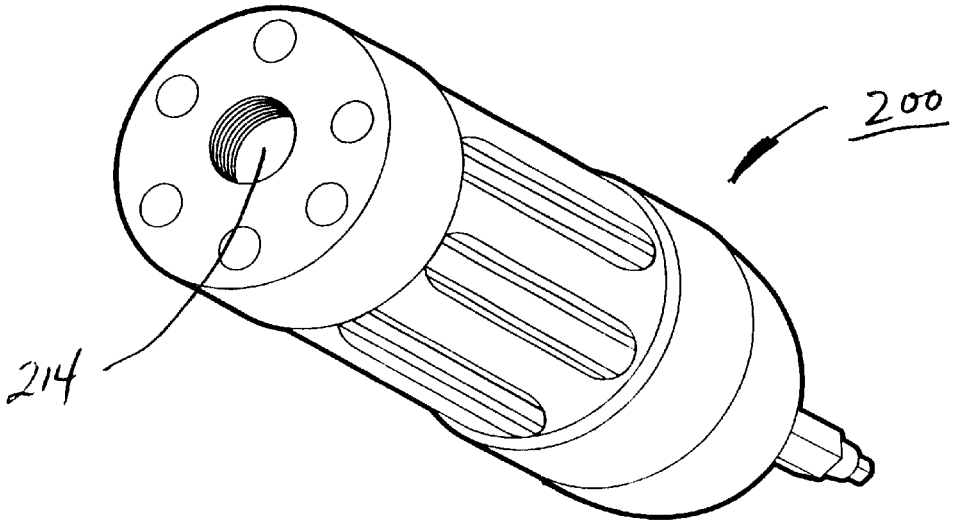
FIG. - 17

230
232
230
200
200

240

242
244
200
242

242

250

200

244

244

BIT HOLDER

This application claims the benefit of Provisional Application No. 60/243,751, filed Oct. 30, 2000.

FIELD OF THE INVENTION

The present invention relates generally to power tools and more particularly to a bit holder adapted to be received in a drill chuck.

BACKGROUND OF THE INVENTION

A number of devices are available on the market for releasably holding and storing tools bits in various containers. The major draw back with the existing devices is that each time a tool bit is selected to be inserted into a drill chuck for example, the chuck must be released and the tool bit must be inserted. There are adapters on the market presently which allow for magnetically receiving and releasing tools bits once such an adapter is placed in a chuck of a drill bit. The draw back of these devices is that the tool bits are held separately from the adapter.

Therefore, it is desirable to have a device which combines both the adapter and the tool bit holding container, such that tool bits are readily available any time and in close proximity to the drill chuck and are similar to existing adapters on the market magnetically received in an adapter for easy insertion and removal.

SUMMARY OF THE INVENTION

The present invention a bit holder for use with a drill chuck comprises:

(a) a shaft means adapted at one end for releasably mounting to the drill chuck, and at the other end for releasably mounting tool bits therein; and, (b) a means for releasably storing tool bits in nested fashion around said shaft such that said shaft means and said storing means rotate in unison with said drill chuck.

Preferably wherein said storing means comprises a framework rigidly attached to said shaft means, said framework defining bit compartments for releasably receiving tool bits therein.

Preferably wherein said framework further includes at least two dividers extending radially from said shaft wherein said dividers define side walls of said bit compartments.

Preferably wherein said framework further includes a circular base and cylindrical retainer wherein said retainer base and dividers define the space of each bit compartment.

Preferably wherein said retainer further includes a means for holding said tool bits within each bit compartment and also for selectively releasing a tool bit.

Preferably wherein said hold meanings includes a retainer opening operable to be positioned for selectively releasing a tool bit.

Preferably wherein said retainer rotates about said base for selectively positioning said opening to release a tool bit.

In an alternate embodiment the invention is a bit holder for use with a handle and comprises:

(a) a shaft means adapted at one end for mounting to the handle, and at the other end for releasably mounting tool bits therein; and, (b) a means for releasably storing tool bits in nested fashion around said shaft such that said shaft means and said storing means rotate in unison with said handle.

BRIEF DESCRIPTION OF THE DRAWINGS

The invention will now be described by way of example only, with references to the followings drawings in which:

FIG. 16 is a schematic front perspective view of an alternate embodiment of a bit holder 200.

FIG. 17 is a rear perspective schematic view of the alternate embodiment bit holder 200 shown in FIG. 16.

DETAILED DESCRIPTION OF THE PREFERRED EMBODIMENT

Figures 10, 11, 12:
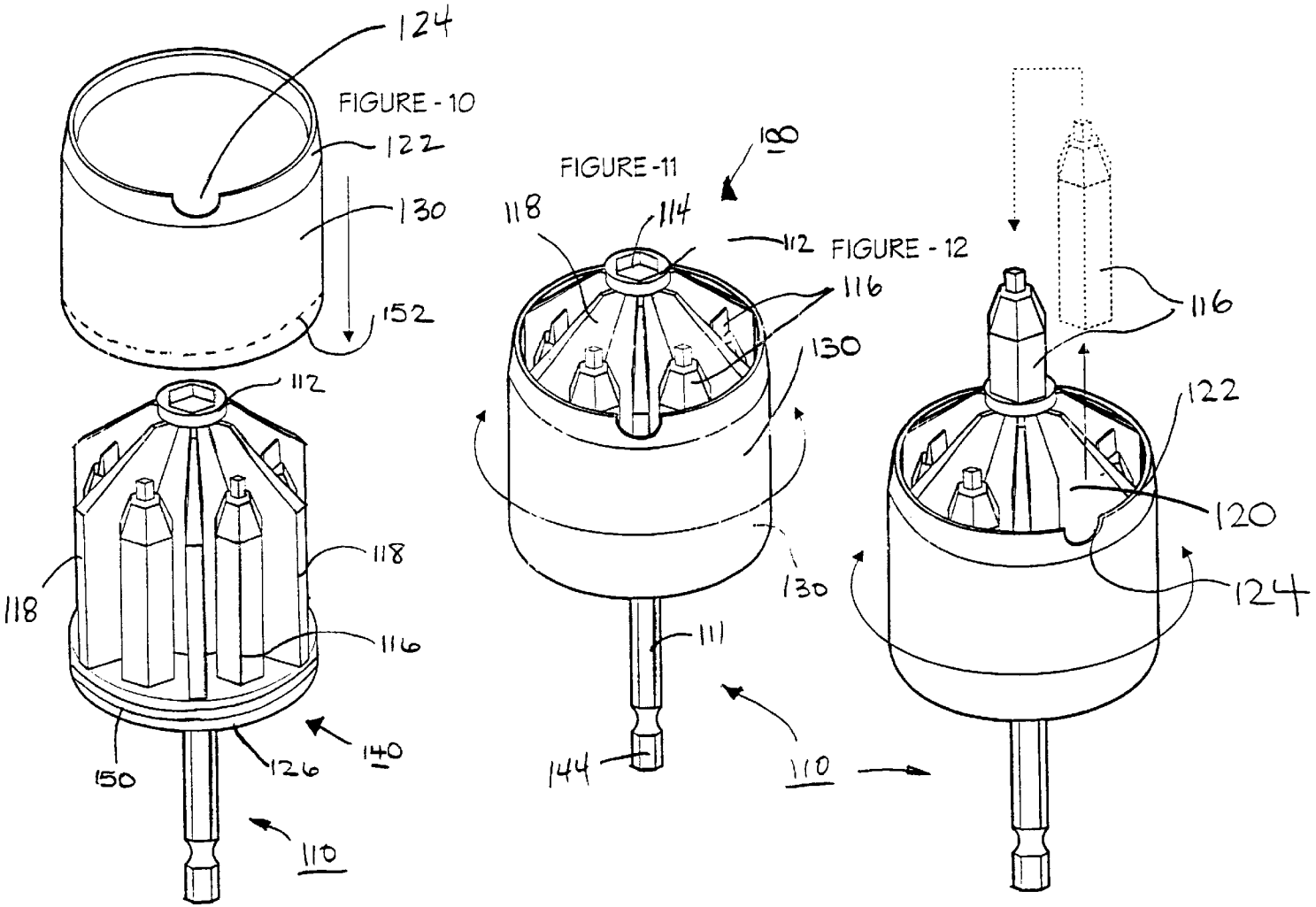
FIG. 10 is a partially exploded perspective view showing the retainer removed from the bit holder.
FIG. 11 is a upright perspective view of the bit holder showing the tool bits nested in their bit compartments.
FIG. 12 is a upright perspective view showing one tool bit inserted in the socket and in shadow the tool bit being removed from an empty bit compartment.
Figure 13:
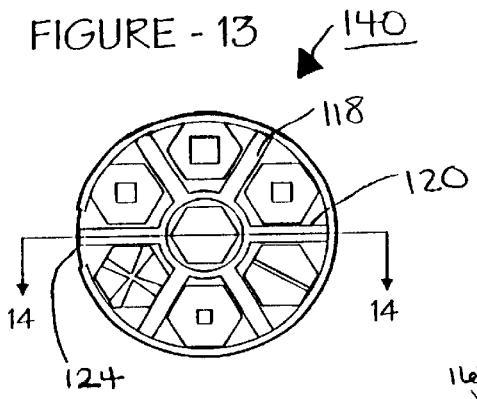
FIG. 13 is a top plan view of the bit holder.
Figure 14:
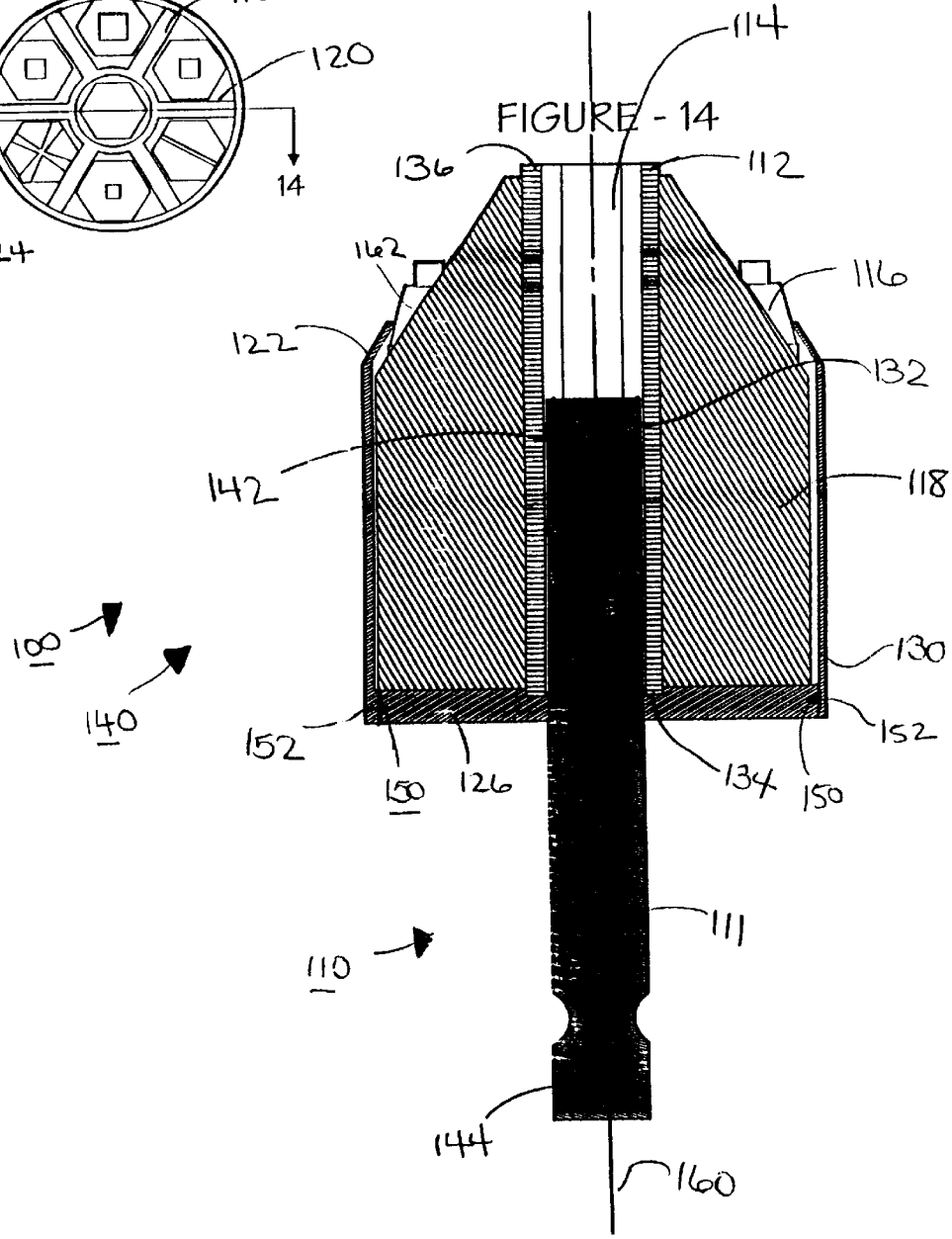
FIG. 14 is a cross-sectional view of the bit holder taken along lines 14—14 in FIG. 13.

Referring to FIGS. 11 and 14 in particular, the present invention of bit holder shown generally as 100 and includes the following components: shaft 110 having a hex portion 111 and a hollow shaft 112.

Preferably hex driver 110 and hallow shaft 112 are metal components which either can be intragally formed out of one piece of metal and/or are rigidly mounted together as shown in FIG. 14. Which ever construction of hex driver 110 combined with hollow shaft 112 is selected, the end results must ensure that when torque or rotational forces are applied to hex driver 110, hollow shaft 112 is rigidly secured enough to hex driver 110 in order to transmit the torque from hex driver 110 to hollow shaft 112.

Figures 1, 2, 3, 4, 5, 6, 7, 8, 9:
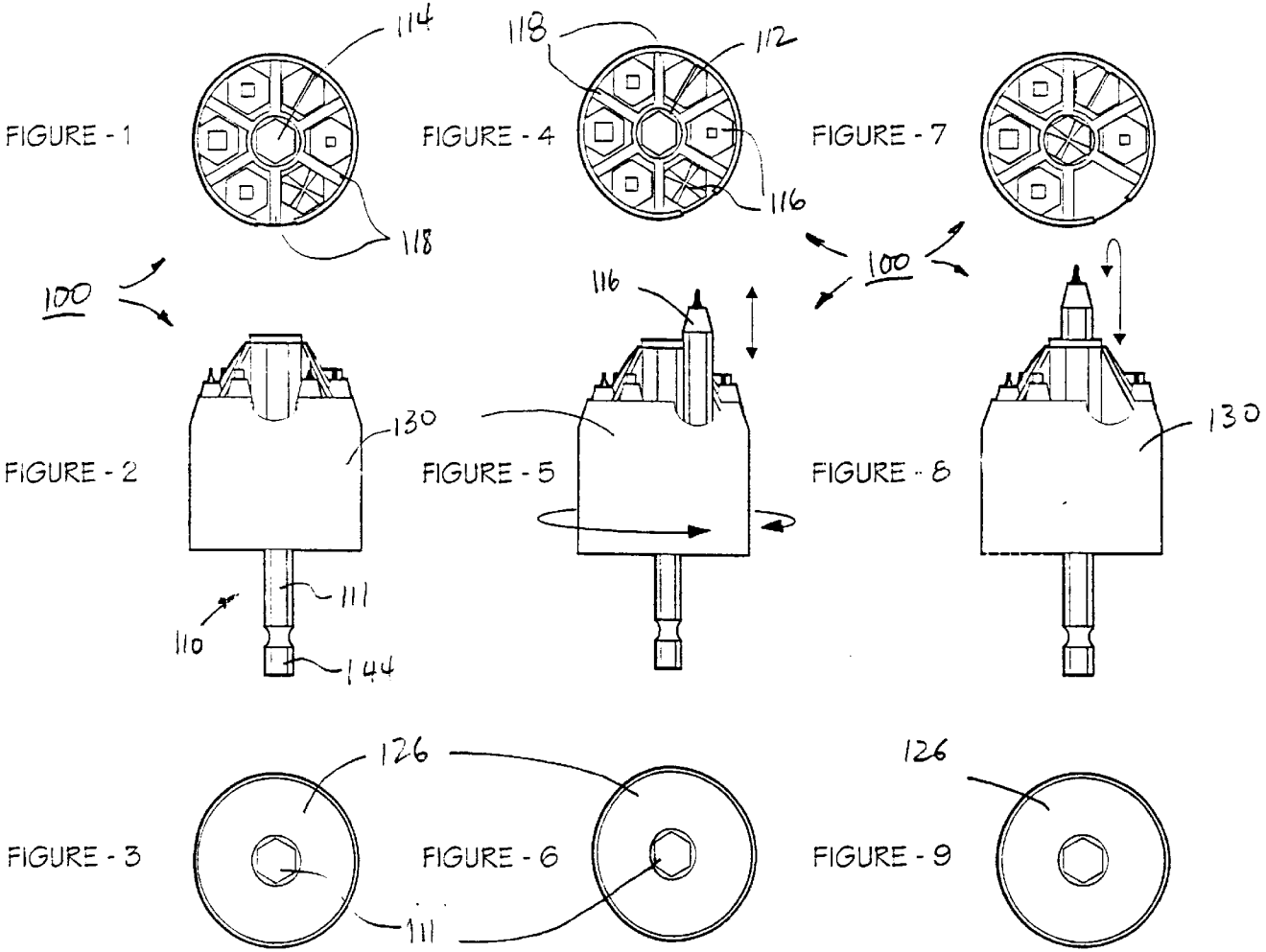
FIG. 1 is a top plan view of the bit holder.
FIG. 2 is a side plan view of the bit holder.
FIG. 3 is a bottom plan view of the bit holder.
FIG. 4 is a top plan view of the bit holder.
FIG. 5 is a side plan view of the bit holder.
FIG. 6 is a bottom plan view of the bit holder.
FIG. 7 is a top plan view of the bit holder.
FIG. 8 is a side plan view of the bit holder.
FIG. 9 is a bottom plan view of the bit holder.

Magnet 132 is imbedded into driver top 142 as shown in FIG. 1 and FIG. 14 and normally there is an interference fit wherein magnet 132 is pressed into a aperture formed in driver top 142. The purpose of magnet 132 is to hold a tool bit 116 into socket 114 and prevent it from falling out of socket 114.

Preferably hex driver 110 is hexagonally shaped of the standard ¼ inch hexagonal driver found on the market place, however it can be dimensioned to other sizes depending upon the application. Similarly socket 114 is a female hexagonal socket adapted to receive hexagonally shaped tool bits 116 having standard dimensions of approximately ¼ inch measured from face to face.

Connected and mounted to the combination of hollow shaft 112 and hex driver 110 is frame work 140 as best shown in FIG. 10 which consists of base 126 and dividers 118. In practice, dividers 118 and base 126 are preferably made by plastic injection moulding, plastic around hex driver 110 and hollow shaft 112.

Once frame work 140 is in place, retainer 130 is placed over bit holder 100 as shown in FIG. 1 whereby a female groove 150 in the outer diameter of base 126 cooperates with male ridge 152 found in the inner diameter of retainer 130, thereby locking retainer 130 onto base 126. It will be apparent to those skilled in the art that many other methods can be used to attach retainer 130 to base 126. The example shown is one of many that can be used to effectively mount retainer 130 onto base 126.

With retainer 130 mounted onto base 126 in this manner, enables retainer 130 to be rotated about a longitudinal axis 160 shown in FIG. 14.

Retainer 130 has a retaining portion 122 which tapers inwardly towards tool bits 116 either impinging upon or coming very close to the tapered shoulders of 162 of tool bits 116 thereby ensuring that tool bits 116 remain within a bit compartment 120.

It will be apparent to those skilled in the art that the retainer 130 can take on various mechanical arrangements not necessarily shown in the diagrams herein. For example the retainer portion 122 may be separate and distinct from the retainer 130. For example a simple rotatable ring having an opening 124 not connected to retainer 130 is possible.

As shown retainer 130 together with frame work 140 defines 6 distinct bit compartments 120 for housing of tool bits 116. There is no reason why this number could be increased or decreased depending upon the final size required of bit holder 100 and also depending upon the total number of tool bits 116 desired to be housed within bit holder 100.

Retaining portion 122 of retainer 130 also has a cut out or retainer opening 124 which can be aligned with a particular bit compartment 120 thereby aligning it with a particular tool bit 116.

In Use

Figure 15:
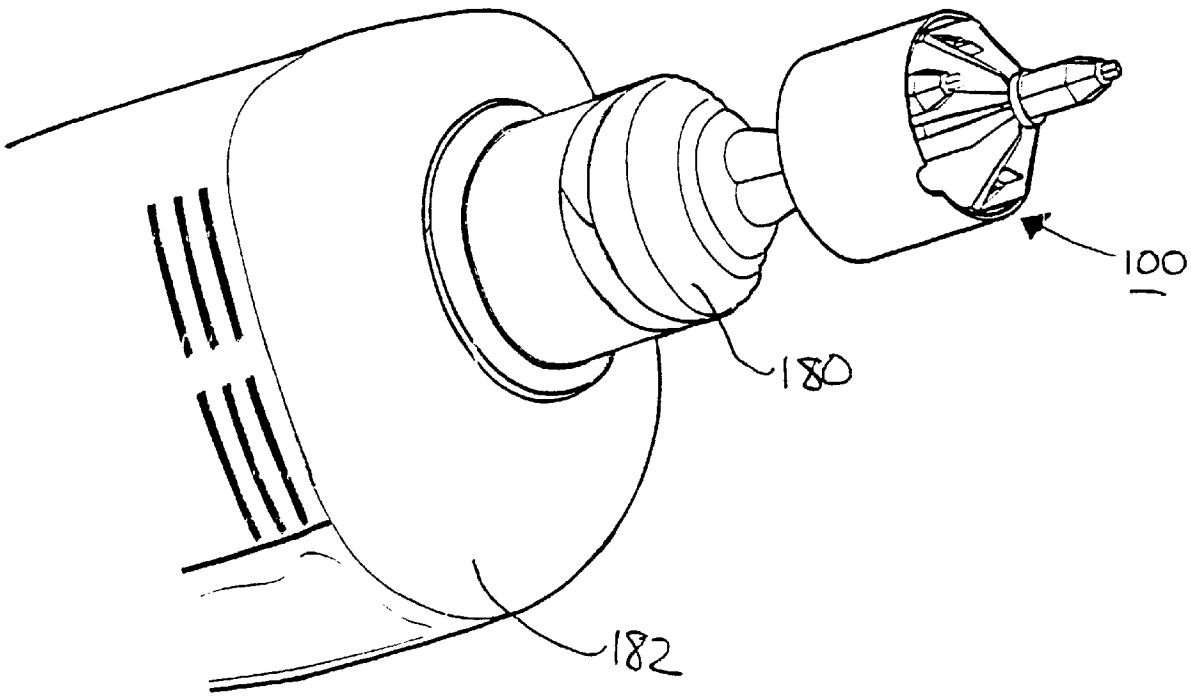
FIG. 15 is a schematic perspective view of the bit holder shown mounted in a drill chuck of a drill.
Figure 18:
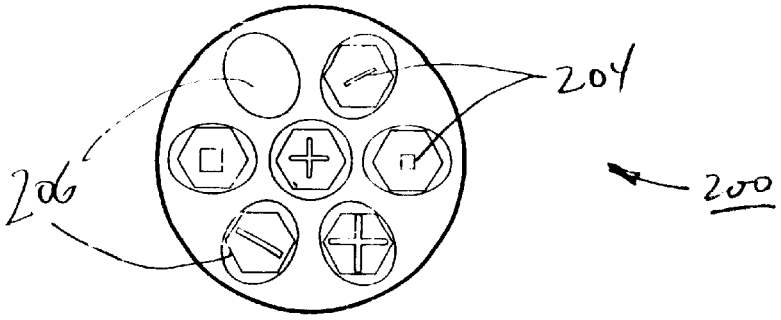
FIG. 18 is a top plan view of the bit holder shown in FIG. 16.
Figure 19:
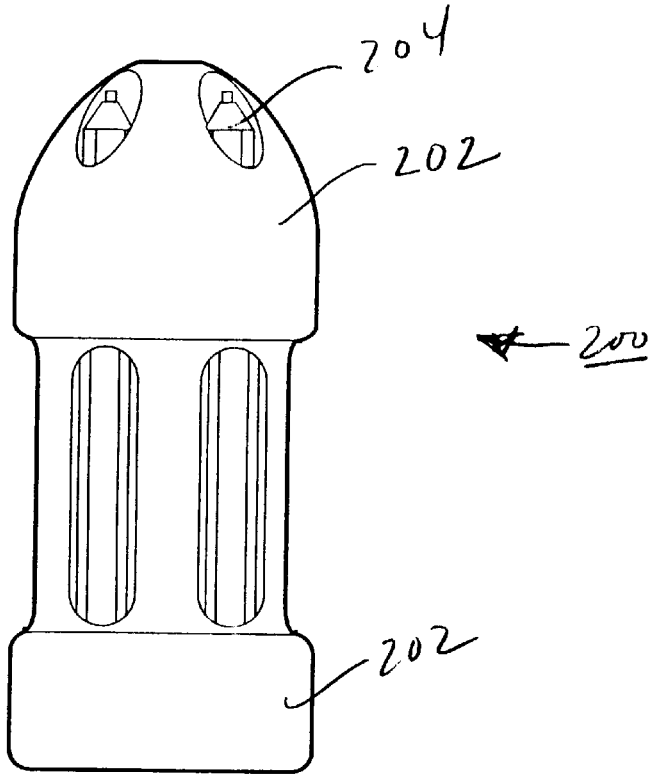
FIG. 19 is a side elevational view of the bit holder shown in FIG. 16.
Figure 20:
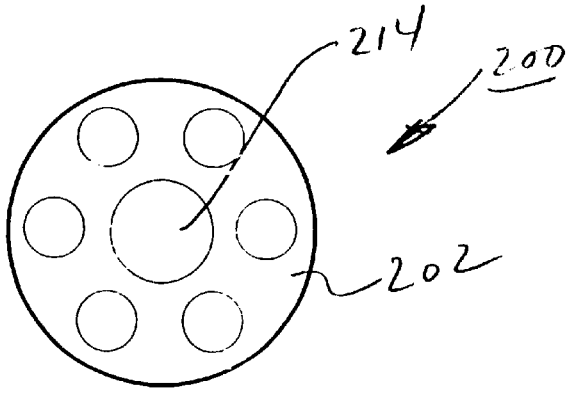
FIG. 20 is a bottom plan view of the bit holder shown in FIG. 16.
Figure 21:
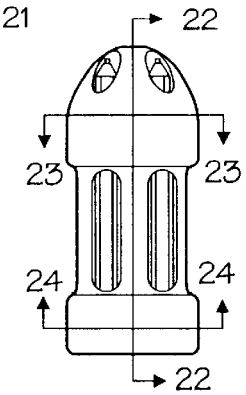
FIG. 21 is a side elevational view of the bit holder shown in FIG. 16.
Figure 23:
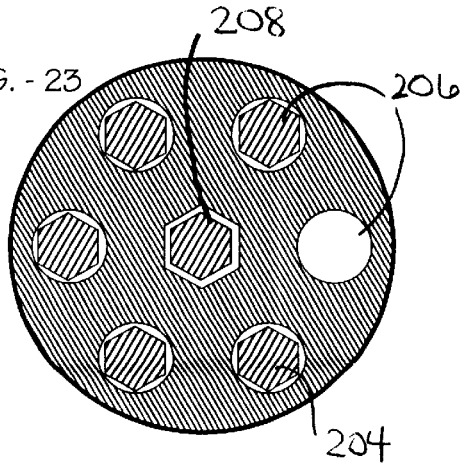
FIG. 23 is a cross sectional view taken along lines 23 shown in FIG. 21.
Figure 24:
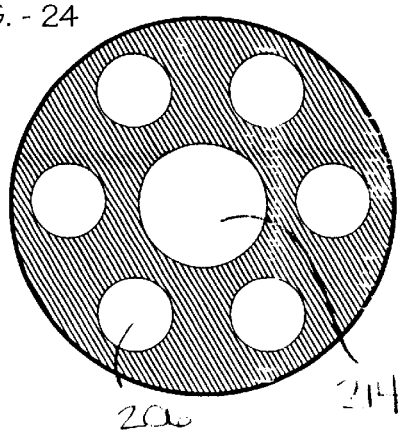
FIG. 24 is a cross sectional view taken along lines 24—24 shown in FIG. 21.
Figure 22:
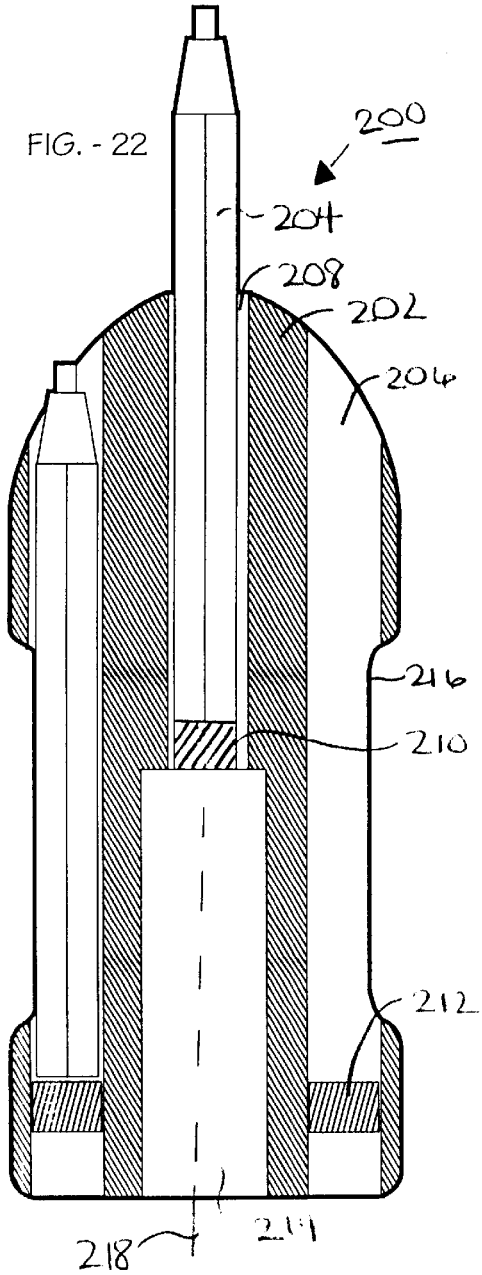
FIG. 22 is a cross sectional view taken along lines 22—22 of FIG. 21.

In use driver bottom 144 of bit holder 100 as best shown in FIG. 15 is mounted into a drill chuck 180 and drill 182. With bit holder 100 mounted in drill chuck 180, a particular tool bit 116 is selected from bit holder 100 by rotating retainer 130 such that retainer opening 124 aligns with the desired bit compartment housing the desired tool bit 116. Retainer opening 124 is so dimensioned as to allow removal of tool bit 116 from its bit compartment 120 thereby positioning tool bit 116 into socket 114 where it is retained thereby magnet 132.

The balance of tool bits 116 in this case the five not retained in socket 114 are retained in their perspective bit compartments 120 by retaining portion 122 of retainer 130.

With a tool bit 116 mounted in socket 114, drill 182 can now be actuated there by rotating the entire bit holder 100 and the end of tool bit 116 can be gauged with a screw or whatever work piece for utilizing the selected tool bit 116.

When none of the tool bits 116 is desired, the tool bit 116 found within socket 114 is removed back to its respective bit compartment 120 and retainer 130 is rotated such that retainer opening 124 aligns with a divider 118 as shown in FIG. 11, thereby locking all of the tools bits 116 and their respective bit compartments 120.

The advantage of bit holder 100 is that the bits are easily selectable since they are located very close to the drill chuck 180 and the work piece being used. It will further be appreciated that a particular tool bit 116 can be easily and quickly selected and placed back into its respective bit compartment 120 such that the tool bits 116 do not become lost.

Further, it will appreciated by those skilled in the arts that various lengths of tool bits 116 can be used depend upon the dimensions of bit holder 100 in addition to the tool bits of the type shown, any standard type tool bit can be used, including drill bits and/or other bits as long as they are adapted to be received cooperatively within socket 114.

As drill chuck 180 rotates thereby rotating hex driver 110, there in turn rotating hollow shaft 112, which there in turn rotates the tool bit 116 found within socket 114, the tool bit within socket 114 can impart torque and/or turning forces onto whatever work piece it is applied to.

It will be apparent to those skilled in the art that the above described mechanism for the selection of tool bits can also be adapted for use as a manual driver. For manual drivers driver bottom 144 instead of being mounted to chuck 180 would be securely mounted to a handle not shown in the drawings. The handle would be designed to fit comfortably in a hand. Bit holder 100 would be rotated by the manual turning of a handle which rigidly connected to bit holder 100.

Presently Preferred Embodiment FIGS. 16 through 37

Referring now to a presently preferred embodiment of the invention which is depicted in FIGS. 17 through 37. The presently preferred invention, a bit holder shown generally as 200 in FIG. 22 includes the following major components, namely housing 202, tools bits 204, six bit compartments defined in housing 202, nested symmetrically about a longitudinal axis 218 of housing 202, a hexagonal socket defined centrally along longitudinal axis 218 within housing 202 for receiving tools bits 204 therein, magnets 210 located at the base of hex socket 208 and magnets 212 located near the bottom of bit compartments 206 for magnetically retaining tools bits 204 within either bit compartment 206 or hex socket 208, a threaded aperture in the rear portion of housing 202 and bit compartment openings 216 corresponding to bit compartment 206 for the purpose of enabling the user to slide a tool bit tool four out of its bit compartment 206 by applying finger pressure.

In Use

Figures 25, 26, 27:
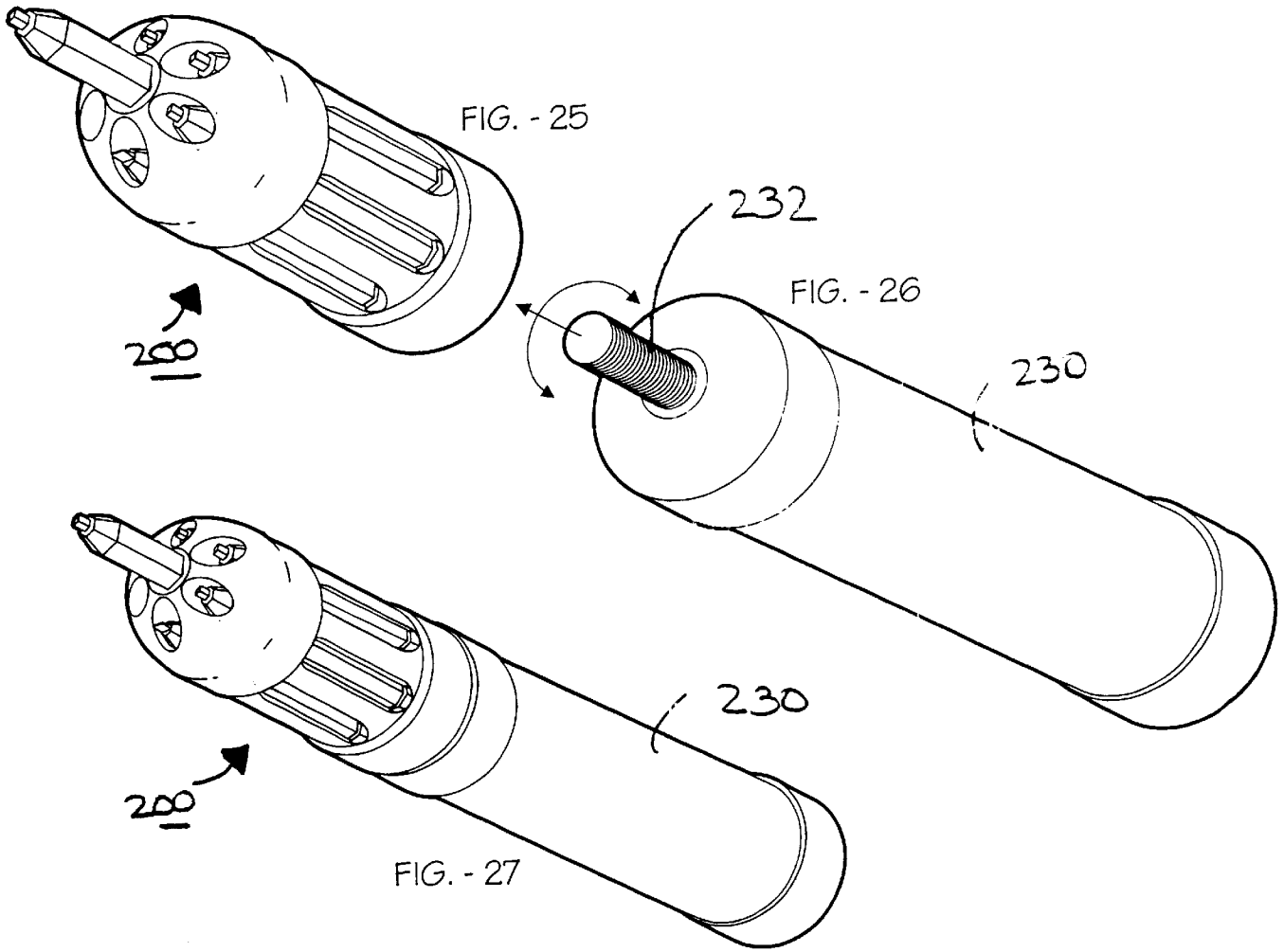
FIG. 25 is an assembly drawing shown the presently preferred bit holder 200 for mounting onto a handle.
FIG. 26 is a front schematic perspective view of a handle for mounting of bit holder 200 thereon.
FIG. 27 is an assembled schematic perspective front view of bit holder 200 mounted onto handle 230.
Figure 28:
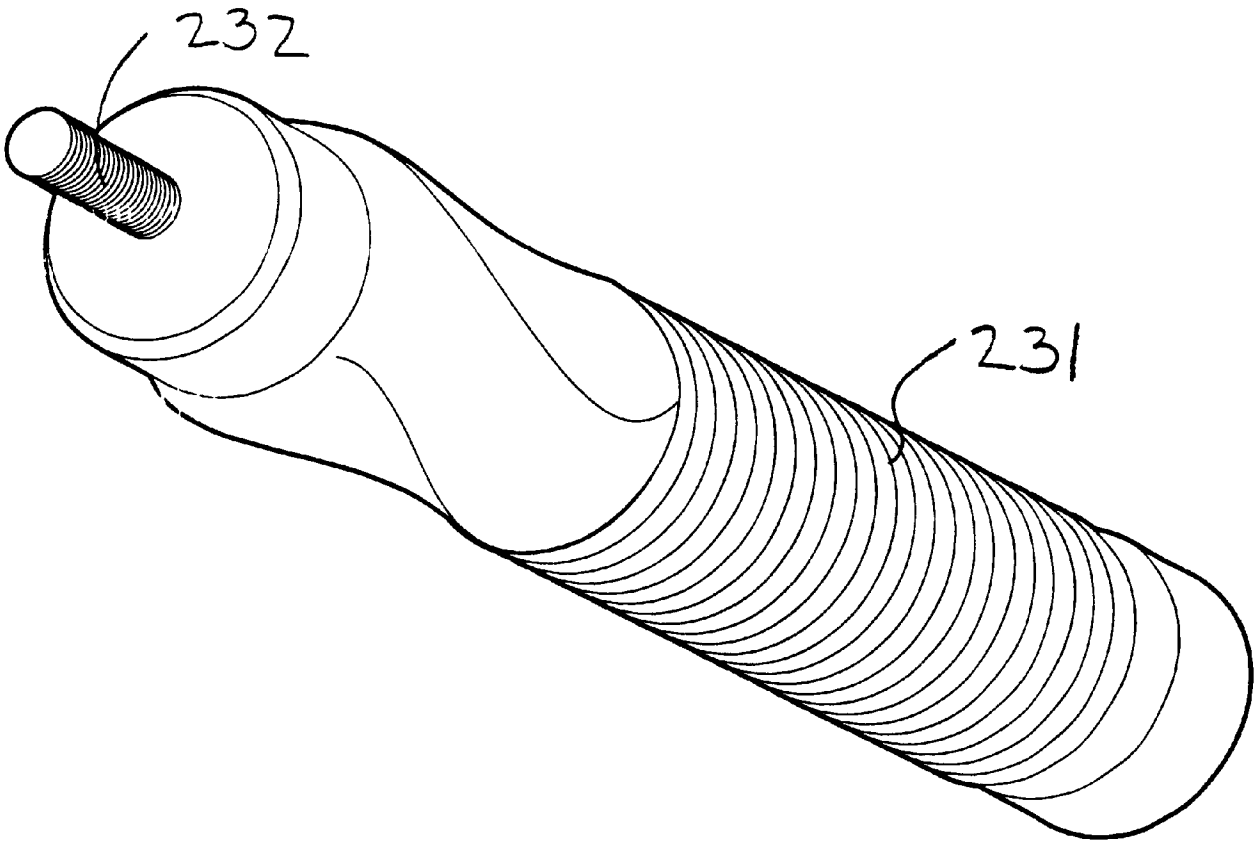
FIG. 28 is an alternate embodiment of the handle shown in FIG. 26.
Figures 29, 30, 31, 32:
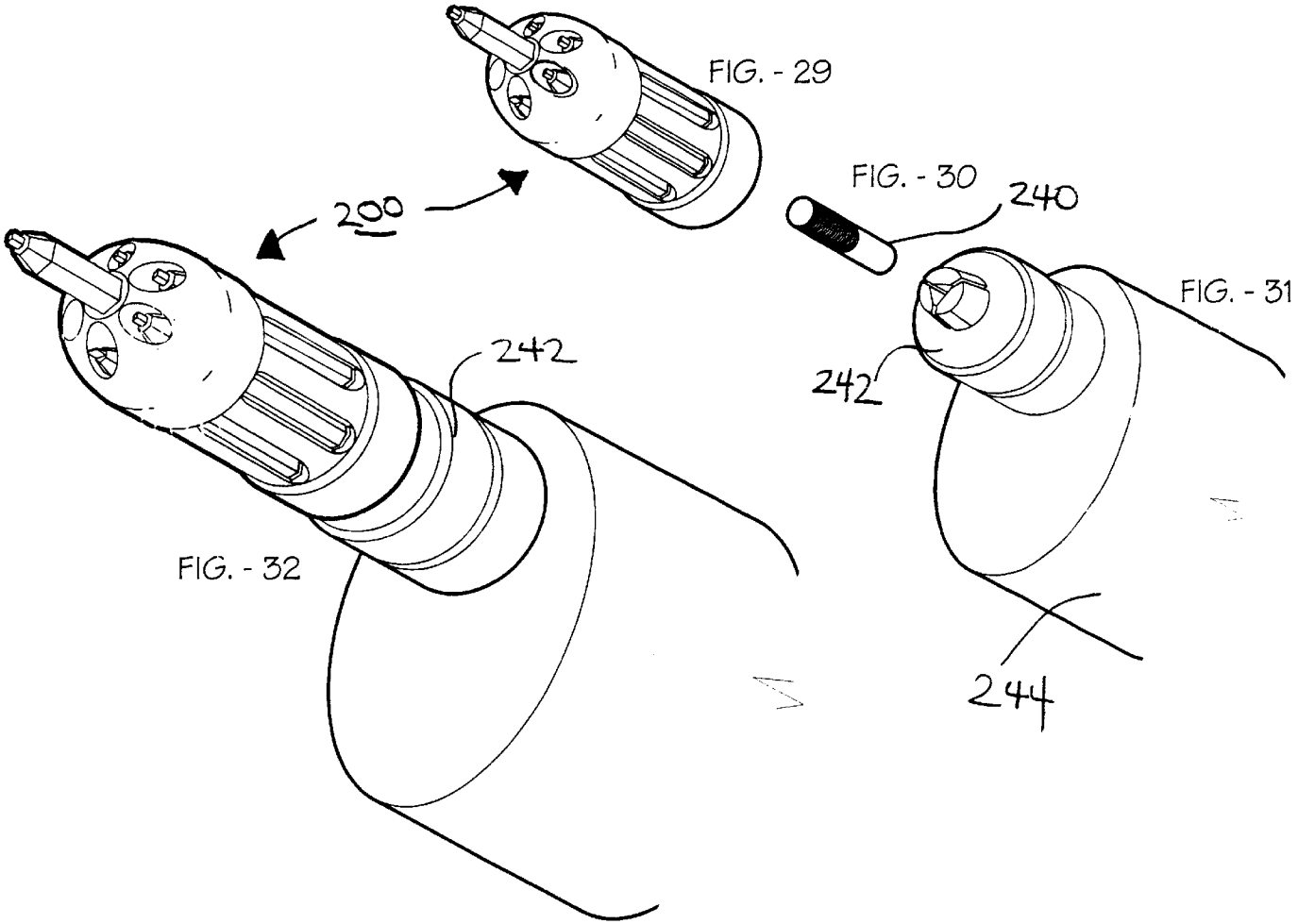
FIG. 29 is a schematic front perspective view of the bit holder shown being assembled into the chuck of a drill.
FIG. 30 is the adapter shaft required for mounting bit holder onto a drill chuck.
FIG. 31 is a partial front schematic perspective view of a drill chuck together with a portion of the drill.
FIG. 32 is an assembled view of the bit holder mounted onto a drill chuck of a drill.

Bit holder 200 can be used as a manual screw driver by affixing it to a handle 230 shown in FIG. 26 via threaded shaft 232 located symmetrically along longitudinal axis 218. Threaded shaft 232 is threadably received within threaded aperture 214 of bit holder 200 thereby securely joining bit holder 200 to handle 230 as shown in the assembled condition in FIG. 27. This configuration, bit holder 200 can be used as a manual bit driver and tools bits 204 can be selected by slideably removing tool bit 204 out of its bit compartment 206 by using finger pressure to slide the tool bit 204 out of bit compartment 206 and manually positioning it slideably into hex socket 208 until magnet 210 holds tool bit 204 within bit socket 208. In this manner a total of seven tool bits can be held magnetically in place by bit holder 200 and each bit can be selected according to need.

Referring now to FIGS. 29, 30, 31 and 32 by using adapter shaft 240 which is threaded on one end to be threadably received within threaded aperture 214 of tool bit 204 and is smooth and/or hexagonally shaped on the other end to be received in drill chuck 242 of a standard portable drill 244 as depicted. By using adapter shaft 240, bit holder 200 can be mounted into a drill chuck 242 and thereby bit holder 200 can be used as a bit driver on a drill 244.

Figures 33, 34, 35, 36, 37:
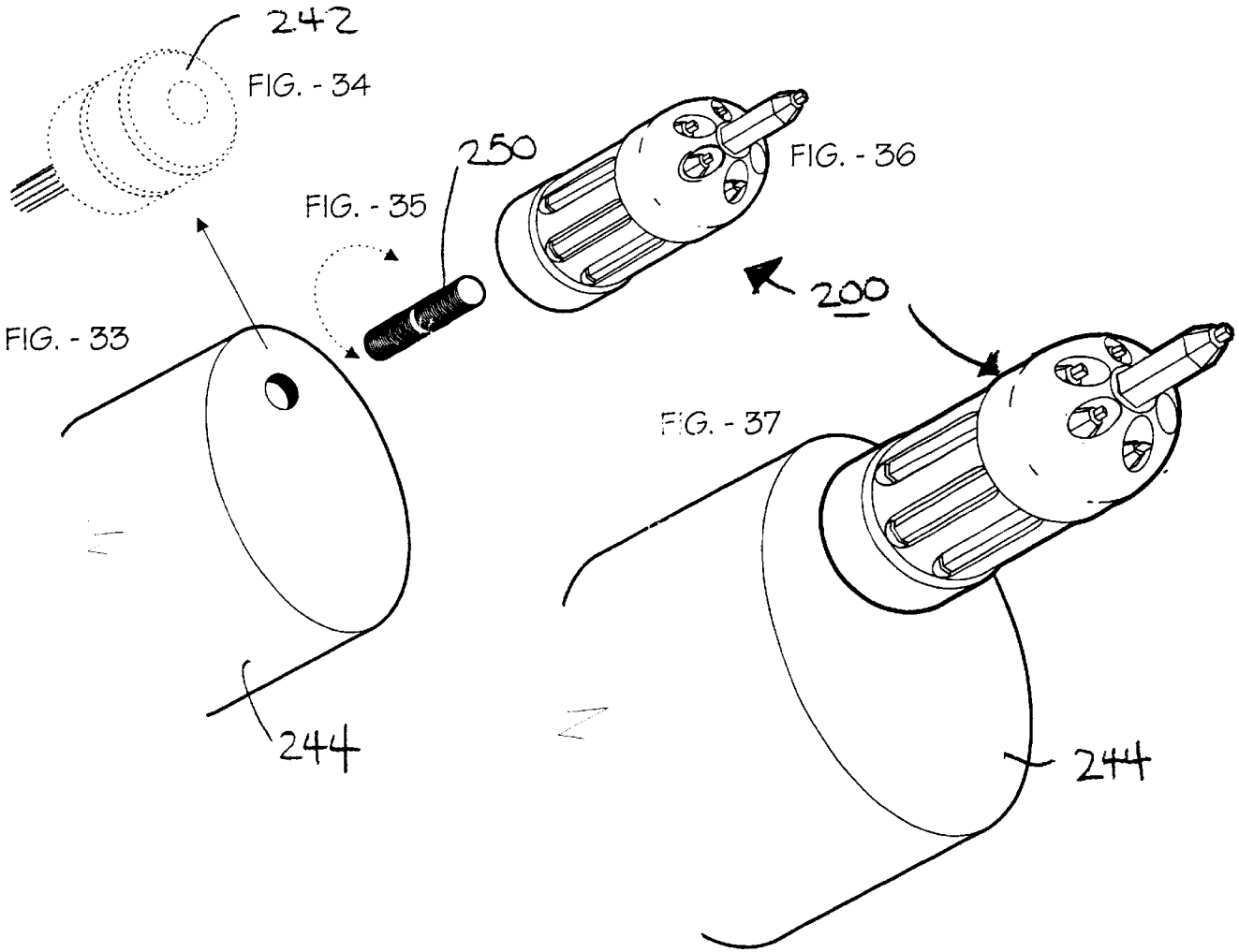
FIG. 33 is a schematic perspective view of a power drill body with the chuck removed.
FIG. 34 is a schematic ghost outline of a drill chuck removed from a drill.
FIG. 35 is a schematic perspective view of a threaded shaft joining a drill with a drill chuck.
FIG. 36 is a schematic front perspective view of the bit holder.
FIG. 37 is an assembly drawing showing the bit holder replacing a conventional drill chuck on a drill.

Referring now to FIGS. 33, 34, 35 and 37, most commercially available drills 244 have a removable drill chuck 242 as shown in FIG. 34. This drill chuck will either leave behind a threaded shaft 250 which is removable and/or projects out of the end of drill 244 where drill chuck 242 was previously mounted. This threaded end is normally either ⅜ fine thread or ½ fine thread and threaded aperture 214 is adapted in size and threading to be threadably received onto threaded shaft 250 which is either integrally part of drill 244 or can be sold as an adapter piece to allow one to mount bit holder 200 directly onto drill 244. In this manner, bit holder 200 essentially replaces drill chuck 242, thereby reducing the weight and the cantilever action of bit holder 200 and minimizes the distance that bit holder 200 projects away from drill 244. This makes for a much more compact installation than that shown in FIG. 32, reduces weight and certainly if of interest to contractors who are constantly using bit drivers.

Alternate Presently Preferred Embodiment

Figure 38:
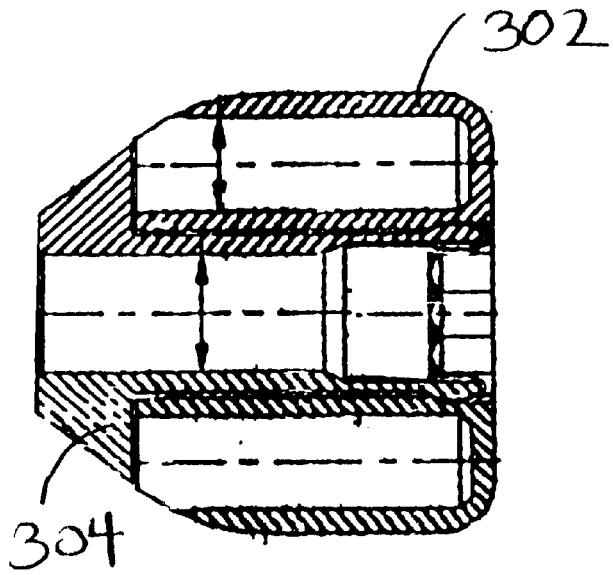
FIG. 38 is a cross sectional view of an alternative embodiment of the present invention, namely bit holder 300.
Figure 39:
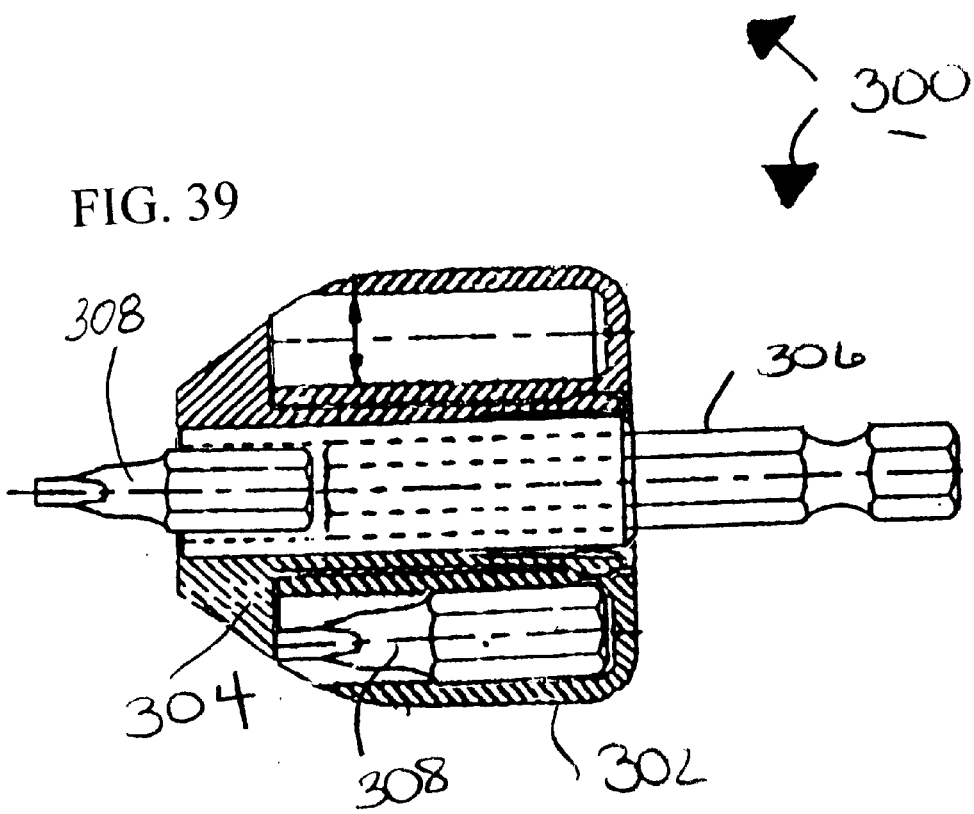
FIG. 39 is a cross sectional view of bit holder 300 showing shaft 306 in place.
Figure 40:
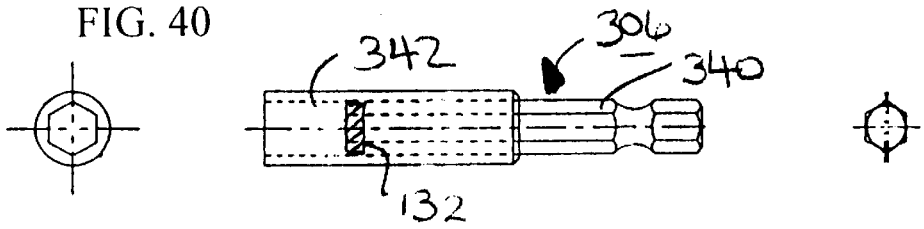
FIG. 40 is a front, side and bottom plan view of a shaft which is part of bit holder 300.
Figure 41:
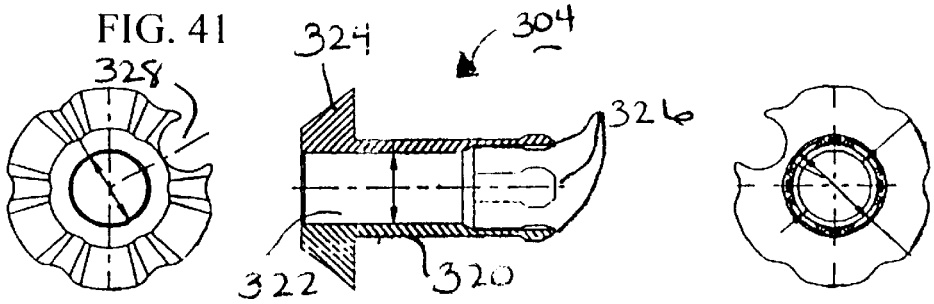
FIG. 41 is a top, side and rear plan view of a sleeve which is part of bit holder 300.
Figure 42:
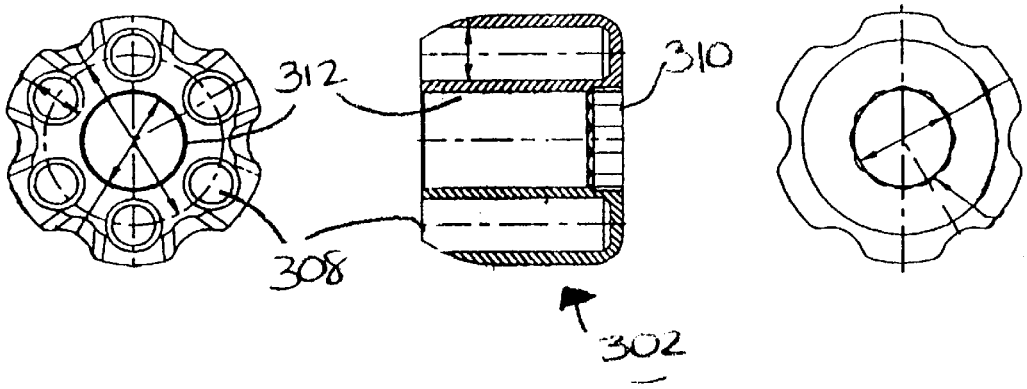
FIG. 42 is a front, side and rear plan view of a housing which is part of bit holder 300.
Figure 43:
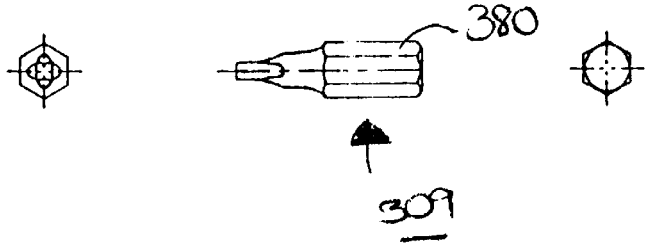
FIG. 43 is a front, side and rear plan view of a tool bit which is part of bit holder 300.
Figure 44:
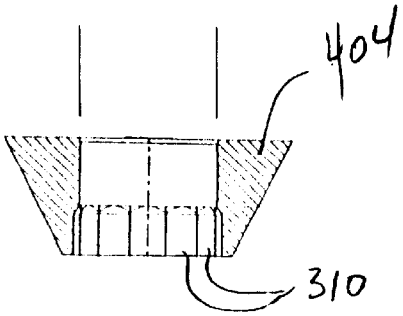
FIG. 44 is a cross sectional view of a sleeve.
Figure 45:
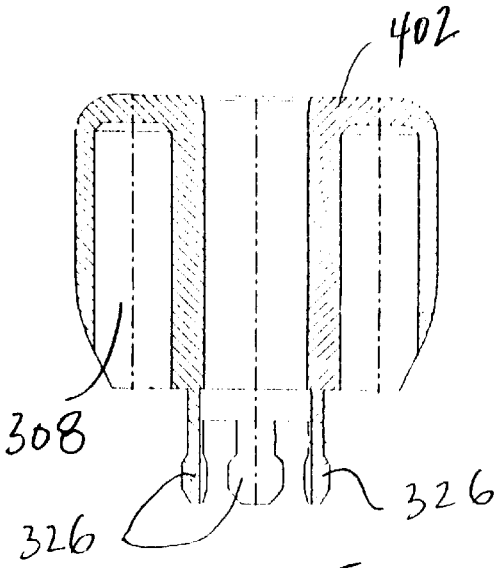
FIG. 45 is a cross section view through a housing.
Figure 46:
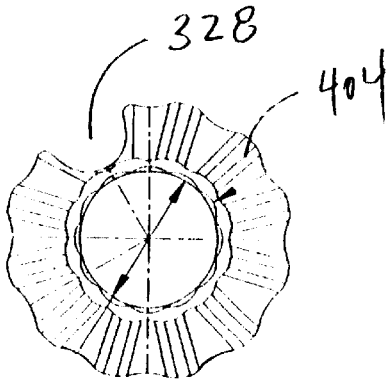
FIG. 46 is a front elevational view of the sleeve shown in FIG. 44.
Figure 47:
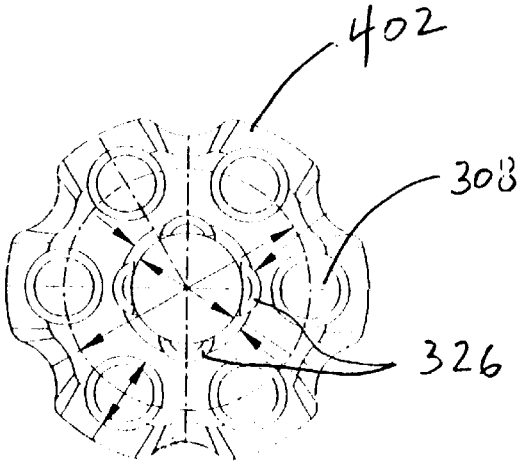
FIG. 47 is a front elevational view of the housing shown in FIG. 45.

An alternate presently preferred embodiment is depicted in FIGS. 38 and on showing the present invention a bit holder 300 which includes the following major components housing 302, a sleave 304, shaft 305, tool bit 309 all of which are assembled together as shown as FIG. 39.

Referring first of all to housing 302 which is preferably injection molded in plastic, it includes the following major components, namely six bit compartments 308 and inter diameter which mates onto out diameter 320 of sleave 304 and a series of twelve groves 310 and the rear portion of housing 302 which comparatively engage with tongues 326 found in sleave 304.

Sleave 304 includes the following major components, retainer portion 324, inner diameter 322 for fitting onto socket portion 342 of shaft 306, outer diameter 320 which acts as a baring surface on which housing 302 rotates and tongue 326 extending rearwardly and cooperatively engaging within grooves 310 of housing 302. Retainer portion 324 further includes an opening 328 through which tool bit 308 may pass through without impediment.

Shaft 306 includes the major elements hex portion 340 which is a hexagonally shaped shaft with a socket portion 342 which is normally metallic in material having a magnet 132 wherein said socket portion 342 is dimensioned to receive the hexagonal shaft of tool bit 308.

Assembly and In Use

The components described above are firstly assembled as follows. The inner diameter 312 of housing 302 fits slideably over the outer diameter 320 of sleave 304 and are slid over until tongue 326 engage with grooves 310 found within housing 302. This assembly of housing 302 and sleave 304 is shown in FIG. 38. This sub assembling is then press fit onto the socket portion 342 of shaft 306 and the inner diameter 322 of sleave 304 is dimensioned to fit interferingly with the outer diameter of socket portion 342, such that when sleave 304 together with housing 302 are press fit onto socket portion 342 of shaft 306 it is rigidly held in place on shaft 306.

The inner diameter 312 of housing 302 is dimensioned to slideably and rotatably fit over outer diameter 320 of sleave 304 such that housing 302 together with tool bit 309 located within bit compartment 308 can rotate around sleave 304 which is stationary and rigidly positioned onto socket portion 342 of shaft 306. Groove 310 cooperatively engaging with tongues 326 of sleave 304 provide resistance to turning of housing 302 which can be overcome by hand pressure, namely manually turning housing 302 and rotating it around sleave 304 such that a clicking action occurs as it is moved from one groove 310 to the next. There are essentially double as many grooves 310 as there are bit compartment 308, such that if there are six bit compartments as shown there are twelve grooves 310 and therefore there are twelve positions to which housing 302 can be moved to. In six of those positions, opening 328 coincides with the opening on one end of bit compartment 308, thereby allowing a tool bits 309 to freely be removed from bit compartment 308 adjacent to opening 328. By moving the housing 302 one click further, this locks all of the bits within their compartments and none of the tools bits 309 can be removed from bit compartment 308 since they are being blocked off by retainer portion 324 of sleave 304.

A tool bit 309 is selected from one of its bit compartment 308 as described above and placed in the socket portion 342 of shaft 306 and held in place by magnet 132. As previously shown in FIG. 15, the hex portion 340 of bit holder can be mounted into a chuck of a drill as shown in FIG. 15 in identical fashion as bit holder 100 is. In this manner, bit holder 300 can be used to quickly and effectively select up to seven bits which can be neatly held within bit holder 300 and organized in such a fashion that they are not lost.

Presently Preferred Alternate Embodiment of a Bit Holder

Figure 48:
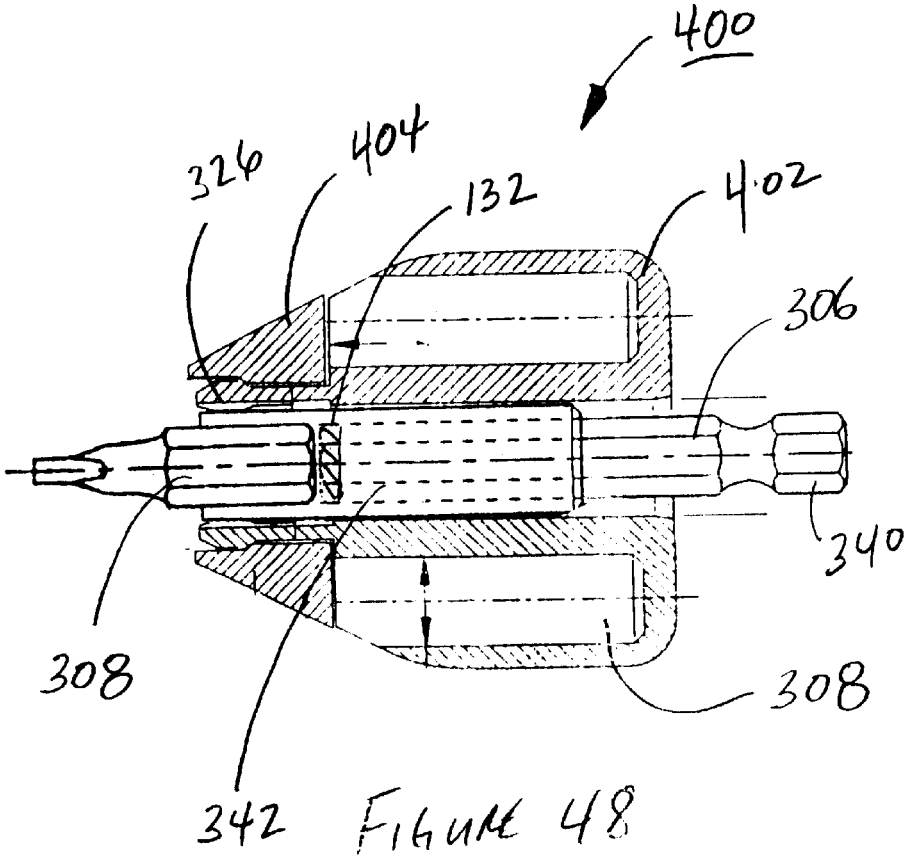
FIG. 48 is an alternate embodiment of a bit holder shown in the assembled state from the components depicted in FIGS. 44 through 47, wherein bit holder 400 is a cross sectional view of the bit holder with a shaft in place including a housing sleeve and bit.

FIGS. 44 through 48 inclusive show an alternate embodiment and a bit holder shown generally as 400 in the assembled state in FIG. 48. Bit holder 400 is very similar to bit holder 300, the major difference being that the tongue and grooves which are located nearest the back of the body 302 for bit holder 300 have been moved to the front of the body 402 for bit holder 400. In order to have the tongue 326 and grooves 310 moved to the front of body 402, sleeve 404 is modified to have the grooves 310 defined therein and the tongues 326 are placed on the front of body 402 rather than on the rear of sleeve 304 as in the previous embodiment. In all other aspects the presently preferred embodiment of bit holder 400 operates and functions in an identical and analogous manner to bit holder 300 with the exception that rather than rotating body 302, sleeve 404 is rotated relative to body 402 which is stationarily mounted onto shaft 306 and sleeve 404 rotates about the tongues 326 and about shaft 306 as shown in FIGS. 44 through 48. In the previous embodiment bit holder housing 302 was rotatably mounted onto sleeve 304 whereas in the presently preferred embodiment, bit holder housing 402 is securely mounted onto the socket portion 342 of shaft 306 and sleeve 304 is mounted over tongues 326 which are now part of housing 402.

In this manner it would apparent to those skilled in the art that is irrelevant whether or not sleeve 404 or body 402 are rotating, but what is important is that either the body or the sleeve are rotating relative to each other and that the tongue 326 and groove 310 mechanism used can be placed either in the forward portion or the rearward portion of bit holder 400 or 300 as shown in the Figures. For that matter the tongue and groove mechanism can be mounted in a different location and yet render the same function.

It should be apparent to persons skilled in the arts that various modifications and adaptation of this structure described above are possible without departure from the spirit of the invention the scope of which defined in the appended claim.

I claim:

1. A bit holder, for use with a drill, said bit holder comprising:

(a) a central longitudinal shaft means adapted at a rear end for releasably mounting into a drill chuck, and a front end adapted for releasably presenting a tool bit protecting forwardly from said front end and for rotatably driving said tool bits;

(b) a storing means for releasably storing multiple tool bits in longitudinally oriented bit compartments spaced from and nested around said central shaft means such that said bits are securely held in place upon rotation of said bit holder by a drill;

(c) wherein said storing means mounted onto said shaft means such that said shaft means rear end projecting rearwardly from said storing means for mounting into a drill chuck, and said shaft means front end projecting forwardly from said storing means;

(d) wherein said storing means including a retaining means for selectively opening and closing said bit compartments thereby selectively retaining or releasing a tool bit; and (e) wherein said storing means including a body and said retaining means including a sleeve, wherein said body and sleeve are cooperatively mounted on said shaft means such that they are rotatable relative each other for selectively opening or closing said bit compartments.

2. The bit holder claimed in claim 1, wherein said sleeve includes an opening for selectively aligning with a bit compartment and thereby releasing a tool bit from a bit compartment.

3. The bit holder claimed in claim 2 including a means for incrementally indexing said sleeve relative said body in an incremental or clicking fashion rotatably about said longitudinal shaft, such that sleeve positions are positively registered in predetermined positions or increments.

4. The bit holder claimed in claim 3, wherein said incremental indexing means includes radially disposed grooves and co-operating tongues, such that rotating said sleeve relative to said body causes said tongues and groves to mesh and releasably maintain said sleeve and body at predetermined indexed positions.

5. The bit bolder claimed in claim 4, wherein said body including forwardly projecting tongues for cooperatively engaging with radially disposed grooves in said sleeve such that said sleeve grooves and body tongues mesh at predetermined rotational intervals for selectively indexing said sleeve.

6. The bit holder claimed in claim 1, wherein said shaft rear end including a round portion.

7. The bit holder claimed in claim 1, wherein said shaft rear end including a hexagonal portion.

8. The bit holder claimed in claim 1, wherein said storing means adapted for substantially closing off said bit compartments thereby preventing tool bits from dislodging during rotation by a drill.

9. The bit holder claimed in claim 1, wherein said body together with said sleeve adapted to substantially enclose tool bits in a retained position for minimizing user contact with tool bits and thereby minimizing user injury upon rotation with a drill.

10. The bit holder claimed in claim 1, wherein said storing means being press fit onto said shaft.

11. A drill attachment, for mounting into a drill chuck and for driving bits, said drill attachment comprising:

(a) a central longitudinal shaft means adapted at a rear end for releasably mounting into a drill chuck, and a front end adapted for releasably mounting tool bits projecting forwardly from said front end and for rotatably driving said tool bits;

(b) a storing means mounted onto said shaft means such that said shaft means rear end projecting rearwardly from said storing means for mounting into a drill chuck, and said shaft means front end projecting forwardly from said storing means; and (c) wherein said storing means for releasably storing multiple tool bits in longitudinally oriented bit compartments spaced from and nested around said central shaft means such that said bits are securely held in place upon rotation of said drill attachment by a drill.

12. The drill attachment claimed in claim 11, wherein said storing means including a retaining means for selectively opening and closing said bit compartments thereby selectively retaining or releasing a tool bit.

13. The drill attachment claimed in claim 12, wherein said storing means including a body and said retaining means including a sleeve, wherein said body and sleeve are cooperatively mounted on said shaft means such that said sleeve is rotatable about said shaft means for selectively opening or closing said bit compartments.

14. The drill attachment claimed in claim 12, wherein said storing means including a body and said retaining means including a sleeve, wherein said body and sleeve are cooperatively mounted on said shaft means such that said body is rotatable about said shaft means for selectively opening or closing said bit compartments.

15. The drill attachment claimed in claim 13, wherein said sleeve includes an opening for selectively aligning with a bit compartment and thereby releasing a tool bit from a bit compartment.

16. The drill attachment claimed in claim 13 wherein said storing means including a means for incrementally indexing said sleeve relative said body in an incremental or clicking fashion about said longitudinal shaft, such that sleeve positions are positively registered in predetermined positions or increments.

17. The drill attachment claimed in claim 16, wherein said incremental indexing means includes radially disposed grooves and co-operating tongues, such that rotating said sleeve relative to said body causes said tongues and groves to mesh at predetermined intervals and thereby releasably maintain said sleeve at predetermined indexed positions relative to said body.

18. The drill attachment claimed in claim 17, wherein said body including forwardly projecting tongues for cooperatively engaging with radially disposed grooves in said sleeve such that said sleeve grooves, and body tongues mesh at predetermined rotational intervals for selectively rotatably indexing said sleeve.

19. The drill attachment claimed in claim 11, wherein said shaft rear end including a round portion.

20. The drill attachment claimed in claim 11, wherein said shaft rear end including a hexagonal portion.

21. The drill attachment claimed in claim 11, wherein said storing means adapted for substantially closing off said bit compartments thereby preventing tool bits from dislodging during rotation by a drill.

22. The bit holder claimed in claim 11, wherein said body together with said sleeve adapted to substantially enclose tool bits in a retained position for minimizing user contact with tool bits and thereby minimizing user injury upon rotation with a drill.

23. The bit holder claimed in claim 11, wherein said storing means being press fit onto said shaft.

24. A drill attachment, for mounting onto a drill and for driving bits, said drill attachment comprising:

(a) a housing aligned and rotatable about a longitudinal axis, including a threaded aperture at a rear end adapted for mounting to a threaded output shaft of a power drill, said housing adapted at the front end for releasably mounting and presenting a tool bit aligned along said longitudinal axis and projecting forwardly from said housing and for rotatably driving said tool bits;

(b) said housing further including a means for releasably storing multiple tool bits in nested fashion around said longitudinal axis such that said housing together with said stored bits rotate in unison about said longitudinal axis and also such that said bits are securely held in place upon rotation of said drill attachment by a drill; and (c) wherein said storing means including multiple longitudinally oriented bit compartments spaced from and nested around said longitudinal axis.

25. The drill attachment claimed in claim 24, wherein said mounting means including an adapter shaft threaded on one end for threadably engaging in said threaded aperture and adapted at said other end for mounting into a drill chuck.

26. The drill attachment claimed in claim 24, wherein said storing means further includes a means for releasably retaining said tool bits within each bit compartment.

27. The drill attachment claimed in claim 26, wherein said retaining means includes magnets for magnetically retaining bits in said bit compartments.

28. The drill attachment claimed in claim 24, wherein said housing further includes bit compartment openings for exposing a longitudinal portion of a bit within a bit compartment, said compartment opening adapted to allow a user to apply finger pressure to slide a bit longitudinally along said bit compartment thereby releasing said bit from said bit compartment.

* * * * *